US006220690B1

(12) United States Patent
Wachi

(10) Patent No.: US 6,220,690 B1
(45) Date of Patent: Apr. 24, 2001

(54) INK JET PRINTER

(75) Inventor: Tetuo Wachi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/408,978

(22) Filed: Sep. 29, 1999

(51) Int. Cl.[7] ..... B41J 2/165
(52) U.S. Cl. ..... 347/30; 347/29; 347/22
(58) Field of Search ..... 347/22, 23, 30, 347/31, 33, 29

(56) References Cited

U.S. PATENT DOCUMENTS 4,628,333 * 12/1986 Terasawa ..... 347/30
4,695,851 * 9/1987 Terasawa ..... 347/30
4,739,340 * 4/1988 Terasawa ..... 347/30
5,701,146 * 12/1997 Akiyama et al. ..... 347/26
5,975,676 * 11/1999 Saijo ..... 347/30

* cited by examiner

*Primary Examiner*—N. Le
*Assistant Examiner*—Lamson D. Nguyen
(74) *Attorney, Agent, or Firm*—Scully Scott Murphy & Presser

(57) ABSTRACT

An ink jet printer having a mechanism to restore the nozzles by suction, thereby preventing the contamination of the nozzles of a printing head caused by waste ink and the mixing of color of ink. The ink jet printer is provided with an air releasing unit used to release a cap chamber equipped below the printing head by a cap of a capping unit. While ink droplets are discharged from the nozzles of the printing head, nozzle suction is performed and the cap chamber is released to the atmosphere through the use of the air releasing unit.

4 Claims, 9 Drawing Sheets

INK JET PRINTER

BACKGROUND OF THE INVENTION

1. Field of the Invention

The present invention relates to a serial-type ink jet printer and more particularly to an ink jet printer so configured that printing functions of a printing head are restored by sucking out thickened ink, dust and the like from a clogged nozzle through the use of negative pressure.

2. Description of the Related Art

A conventional serial-type ink jet printer is known wherein ink is discharged from a nozzle formed on a nozzle forming face of a printing head to perform printing.

In the conventional ink jet printer of this kind, image information covering one line is printed on paper while a printing head scans to and from once or more than one time in the direction of the width and, when the printing covering one line is terminated, it is started on a new line again by scanning in the direction of the width.

The ink jet printer can provide printed images with high quality and has an advantage that its printing head produces comparatively less noise while being printed.

However, the conventional ink jet printer presents a problem in that a nozzle of the printing head, when not in use, may get clogged up with dried ink, dust and floating materials in the air. Solidified ink, adhered dust and the like may cause defective discharging of ink (so-called "dot omission") and interfere with normal printing. To prevent this, when the nozzle is not in use, the printing head is taken off from the ink jet printer to be housed in a keeping box or a nozzle forming face of the printing head is sealed to prevent drying of ink, adherence of dust and the like. However, it is inconvenient for a user to take the printing head off from the ink jet printer and to house it in the keeping box in every use and, in many cases, such storing of the printing head in the keeping box is not put into practice accordingly.

Another method for solving the problem of clogging of the nozzle of the printing head is to provide the ink jet printer with a nozzle restoring mechanism in which printing functions of the printing head are restored by using suction processes.

The conventional nozzle restoring mechanism is so configured that caps surrounding a group of nozzles in a closed contact with a nozzle forming face of a printing head are provided and air within a sealed cap chamber formed by the cap and the nozzle forming face is sucked so that solidified ink, dust and the like within the nozzle are sucked out forcedly together with air. The nozzle restoring mechanism, unlike in the case of using the keeping box, has an advantage that there is no need for intervention of users. That is, the ink jet printer is provided with a nozzle restoring section on the side of its printing section and, when the nozzle is not in use, the printing head is automatically brought to the position of the nozzle restoring section.

However, the conventional nozzle restoring mechanism using suction processes presents a problem in that waste ink residing in the cap after the suction has been carried out (or waste ink residing within a path of ink discharged by the suction) invades backward into the nozzle by residual negative pressure within the nozzle of the printing head, causing the nozzle to be contaminated with waste ink.

The influence by the contamination remarkably shows up in a color ink jet printer in particular. Recently, users tend to prefer the color ink jet printer that can provide color printing. In response to these demands, the recent ink jet printer can use multicolor ink and is provided with a printing head with nozzles that can be operated in use with such various color ink. In such a color ink jet printer, if waste ink is present even in trace amounts, it causes a color image to be degraded. Especially, for example, if bright color ink such as yellow ink or the like is mixed with dark color ink such as black ink, the resulting color image decreases in the quality, causing a feeling of visual strangeness.

Such a malfunction caused by the mixing of ink having different components does not always occur only in ink jet color printers. For example, in the case of an ink jet printer using black ink only, the printing head with different specifications uses black ink having different components. In any case, therefore, mixing of ink must be avoided in the operation of printers.

SUMMARY OF THE INVENTION

In view of the above, it is an object of the present invention to provide an ink jet printer provided with a mechanism to restore at least one nozzle by suction which can prevent the contamination and clogging of the nozzle of a printing head caused by waste ink, dust and the like. It is another object of the present invention to provide an ink jet printer being able to restore functions of nozzles of the printing head without using a keeping box.

According to an aspect of the present invention, there is provided an ink jet printer having a mechanism to restore at least one nozzle by suction, comprising:

a carrier on which a printing head is mounted;

a guide shaft to guide the carrier;

a guide frame;

a nozzle restoring unit including a frame, a capping unit supported by a frame, a negative pressure generating unit and an air releasing unit; and a driving shaft;

whereby the nozzle forming face of a printing head is sealed with a cap when the nozzle is not in use and printing function of the printing head are restored, with the air releasing unit closed, by sucking ink and/or dust from the nozzle by negative pressure applied to a sealed space formed by the printing head and the cap;

the air releasing unit being used to release the sealed space to the atmosphere, with the air releasing unit opened, while ink is being discharged from the nozzle of the printing head at a terminal stage of the suction process by negative pressure.

In the foregoing, a preferable mode is one wherein the negative pressure generating mean is used to generate negative pressure to be applied to the sealed space, and the negative pressure generating means and air releasing means are individually driven by first and second cam members each having a different phase, which are both mounted on the same cam axis.

Also, a preferable mode is one wherein phases of the first and second cams are set so that, before a nose of the first cam points to the lowest point representing the termination of the negative pressure generating operation of a pump driving unit, or when it points to a position where an angle of $\theta$ is formed with respect to the lowest point, a flat face of the second cam points to the direction of the lowest point.

Also, a preferable mode is one wherein the air releasing unit is composed of the tube, one end of which is communicated with the cap and the other end of which is used to release air, a crushing member formed on the frame and used to crush the tube using the second cam to cut off air and a receiving member used to support the tube when crushed.

Also, a preferable mode is one wherein the air releasing means is activated to release the nozzle to the atmosphere while the discharging of ink from the nozzle continues.

Furthermore, a preferable mode is one wherein the suction by the negative pressure and releasing of air are performed by a predetermined timing.

BRIEF DESCRIPTION OF THE DRAWING

The above and other objects, advantages and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Figure 1:
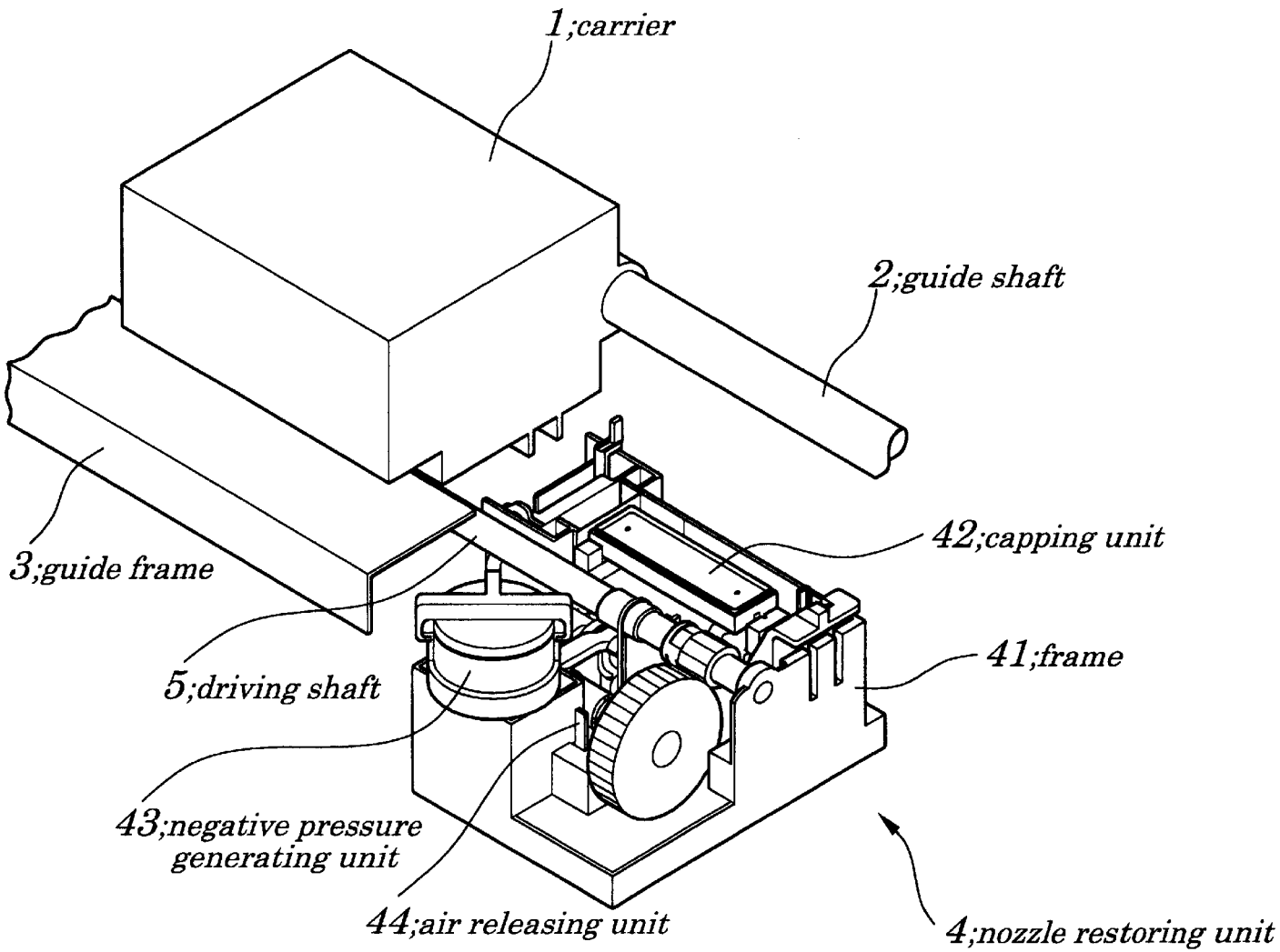
FIG. 1 is a perspective view showing a nozzle restoring unit of an ink jet printer of the present invention.

As shown in FIG. 1, the ink jet printer of the present invention is provided with a carrier 1 on which a printing head 11 is mounted, a guide shaft 2 to guide the carrier 1, a guide frame 3, a nozzle restoring unit 4 and a driving shaft 5.

The nozzle restoring unit 4 consists of a frame 41, a capping unit 42 supported by the frame, a negative pressure generating unit 43 and an air releasing unit 44.

The carrier 1 has a hole through which the guide shaft 2 comes and a sliding member (not shown) and is supported by the guide frame 3 through the guide shaft 2 and the sliding member. The carrier 1 is so configured that it can move along the guide shaft 2 in the direction of an axial line by a belt conveying means (not shown) driven by an external driving motor (not shown).

As depicted in FIG. 3, the printing head 11 is disposed below the carrier 1.

Figure 2A:
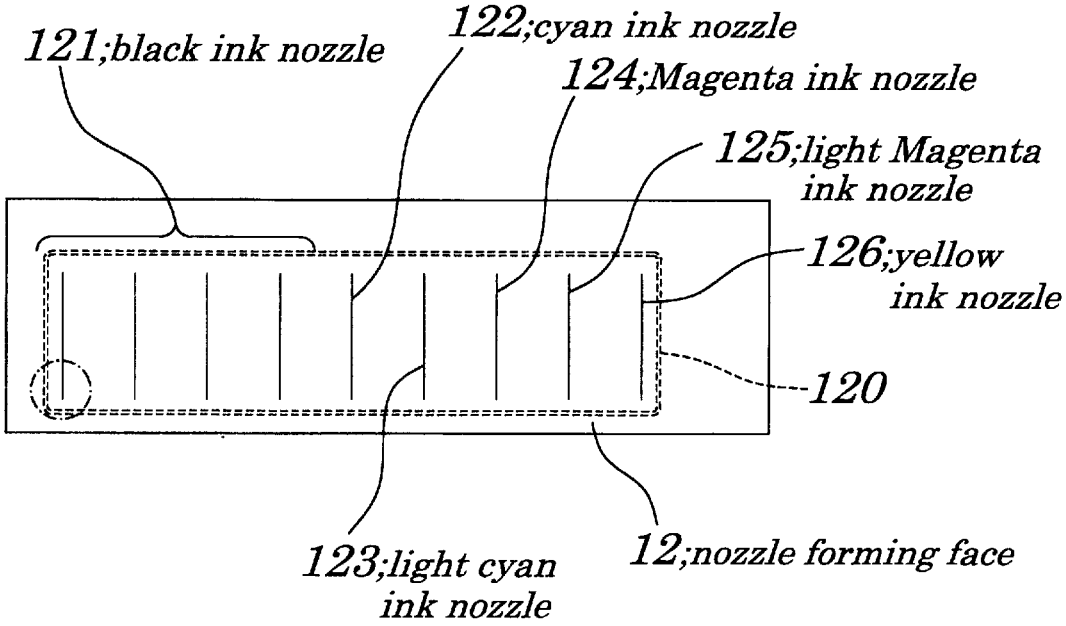
FIG. 2A is a schematic diagram, seen from below, of a printing head of the ink jet printer shown in FIG. 1

FIG. 2A is a bottom view approximately showing a nozzle forming face 12 of the printing head 11. Referring to FIG. 2A, a frame 120 shown by the dotted lines illustrates a contact portion between the top end of the capping unit 42 of the nozzle restoring unit 4 and the nozzle forming face 12.

Figure 2B:
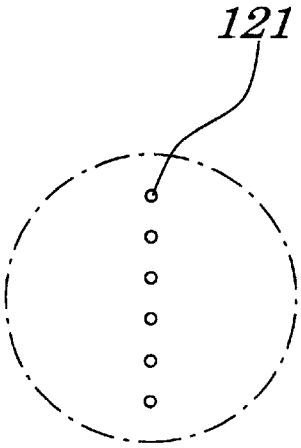
FIG. 2B is an enlarged view of a portion encircled by a circular shown in FIG. 2A.

On the nozzle forming face 12 of the printing head 11 are formed a black ink nozzle 121, a cyan ink nozzle 122, a light cyan ink nozzle 123, a Magenta ink nozzle 124, a light Magenta ink nozzle 125 and a yellow ink nozzle 126 and, as shown in an enlarged view of FIG. 2B, two or more nozzle rows are arranged at equal intervals vertically in the drawing.

An ink drop, as a shape of a piezo device (not shown) disposed at the back of the nozzle changes, is pushed and discharged out of the nozzle.

As in the case of known ink jet printers, the ink jet printer of the present invention is also so configured that printing information to be printed on printing media such as paper is performed by discharging ink out of the nozzle formed on the nozzle forming face 12 of the printing head 11.

As shown in FIG. 1, the nozzle restoring unit 4 is placed at a nozzle restoring section disposed at the outside of a printing section where printing is performed by moving the carrier 1 in the direction of an axial line of the guide shaft, and when the printer is not in use, the carrier 1 is returned back to the nozzle restoring section so as to stand ready for subsequent printing.

Figure 3A:
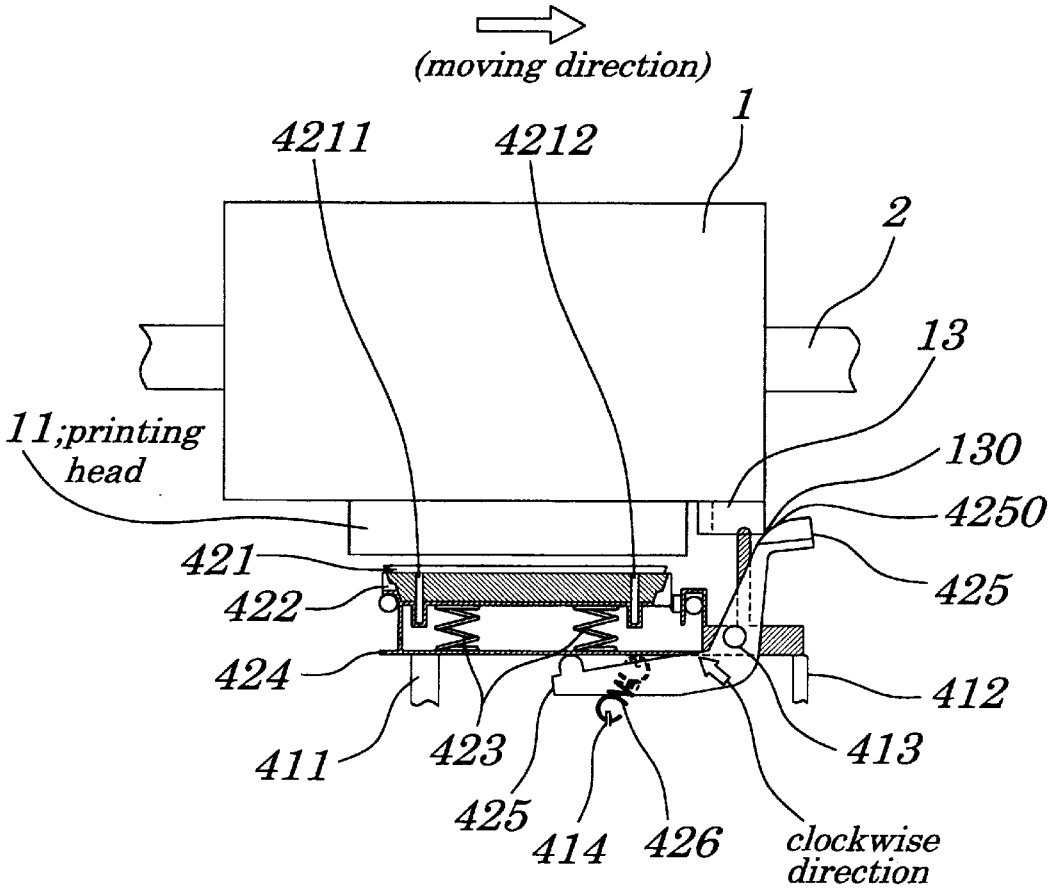
FIGS. 3A and 3B are cross-sectional views, seen from the front, of a capping unit of the ink jet printer shown in FIG. 1, and FIG. 3A showing the state before being capped and FIG. 3B showing the state being capped.
Figure 6:
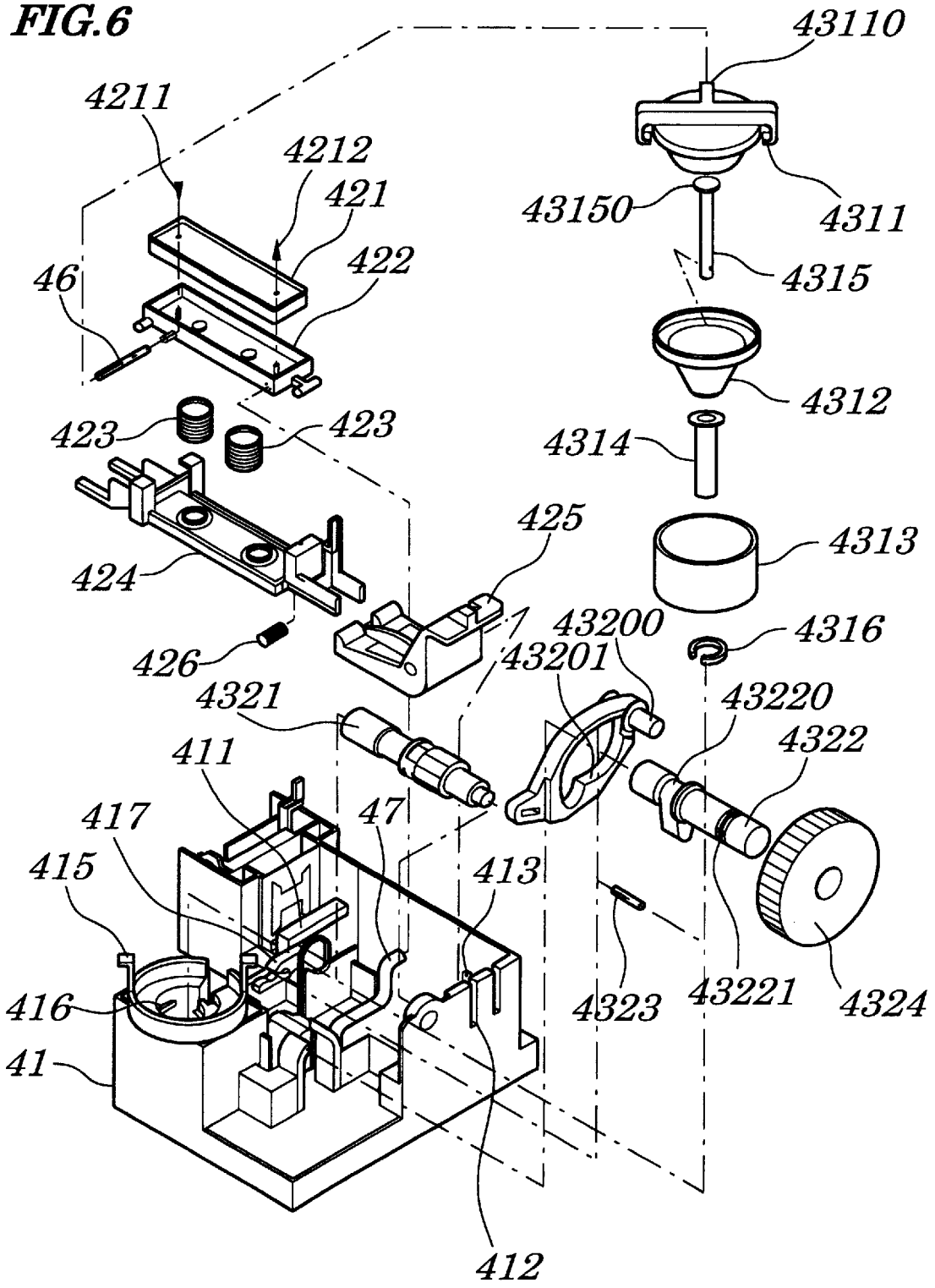
FIG. 6 is an exploded perspective view of a nozzle restoring unit shown in FIG. 1.

Referring to FIGS. 3A and 6, the capping unit 42 is provided with a cap 421 to seal the nozzle forming face and a pressing means to press the cap 421 to the nozzle forming face. The pressing means consists of a cap holder 422, a compressed spring 423, a bracket 424, a cap lever 425 and a tension spring 426. The cap 421 is so configured that it is surrounded by an enclosure with a uniform height to make its cross-section concave and is opened on its side opposite to the nozzle forming face 12. The cap 421 is made of an elastic material such as rubber and, when the top end of the enclosure is contacted, by pressure, with the nozzle forming face 12, a sealed cap air chamber 4213 (see FIG. 3B) is formed.

As shown in FIG. 6, in the position opposite to the black ink nozzle 121 and in the position opposite to the yellow ink nozzle 126 at the bottom of the cap 421 are formed a sucking port 4211 and an air communicating port 4212 respectively. By this arrangement, the ink collected in the cap air chamber 4213 flows from a bright color position to a dark color position therein. The cap holder 422 is disposed below the cap 421. Communicating paths to communicate the sucking port 4211 of the cap 421 with a first tube 46 and communicate the air communicating port 4212 with a second tube 47 respectively are provided. The cap 421 is pressed against the nozzle forming face 12 by a protrusion formed at the lower portion of the carrier 1.

Referring FIGS. 3A and 6, the capping unit 42 is composed of the cap lever 425 which swings with respect to a rotary axis 413 to lift the bracket 424 by being contacted by the protrusion 13 of the carrier 1, the cap holder 422 used to hold the cap 421, by pressure, to the contacting section 120 (see FIG. 2) surrounding the nozzle forming face 12 and to press up the compressed spring 423 so that its loads are imposed uniformly on the contacting section 120, and the bracket 424 to hold the cap holder 422 through the compressed spring 423. The bracket 424 is pulled, by the tension spring 426, toward the hook 414 of the tensile spring mounted on the frame 41 and held by holding sections 411 and 412 of the capping unit formed on the frame 41.

Figure 4A:
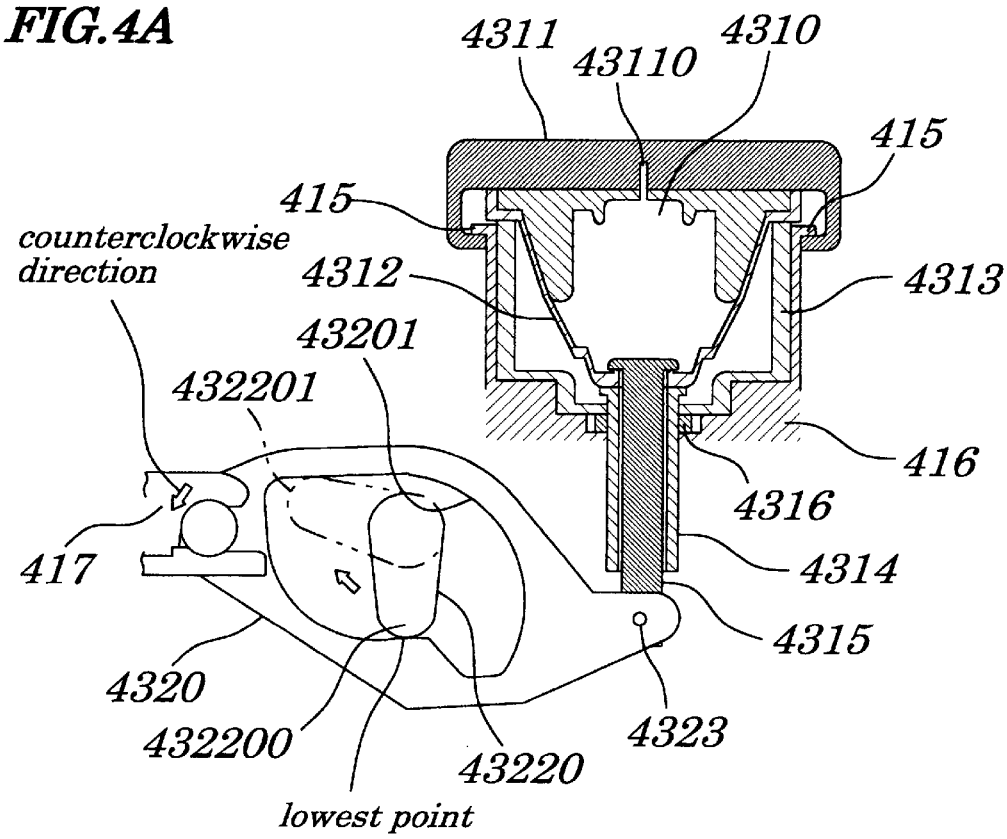
FIGS. 4A and 4B are cross-sectional views showing operations of a negative pressure generating unit of the ink jet printer shown in FIG. 1.
Figure 4B:
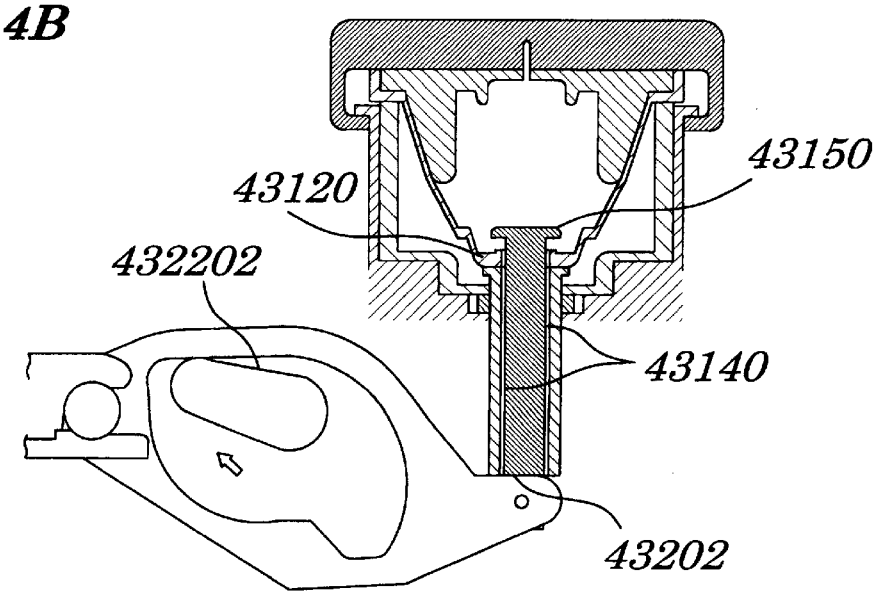

By referring to FIGS. 4A, 4B and 6, the negative pressure generating unit 43 is hereafter described. The negative pressure generating unit 43 contains a diaphragm pump communicating with the cap 421 by the first tube 46 and a pump driving unit to transfer external driving power to the diaphragm pump. The diaphragm pump is provided with a cover 4311, a diaphragm 4312, a pump frame 4313, a shaft cover 4314, a shaft 4315 and a loading ring 4316.

The cover 4311 has a cap communicating port 43110 into which the tube 46 is inserted to be connected thereto. The diaphragm 4312 co-operates with the cover 4311 to form a pump chamber 4310 having variable volume.

The pump frame 4313 is used to seal and hold the cover 4311 and the diaphragm 4312 against the cover lock section 415 formed by the frame 41.

The shaft cover 4314 is used to supply a force that acts on a bottom surface 43120 of the diaphragm 4312 and push the same in the direction to reduce the volume of the pump chamber 4310.

The shaft 4315 has a disc-shaped valve section 43150 within the pump chamber 4310 and have the pump chamber cut off from air by bringing the disc-shaped valve section 43150 into intimate contact with the bottom surface of the diaphragm 4312.

The loading ring 4316 is located between a pump frame holding section 416 formed by the frame 41 and the pump frame 4313. The loading ring 4316 is used to impose loads on the shaft cover 4314 when the shaft cover accomplishes up-and-down movements.

The pump driving unit has a swinging pump lever 4320, a first gear 4321 and a second gear 4324 engaged with the first gear 4321. The second gear 4324 is constructed so as to be integral with a cam shaft 4322 and the former drives the latter to be rotated. The cam shaft 4322 has a first cam 43220 and a second cam 43221. The swinging pump lever 4320 of the pump driving unit is coupled to the shaft 4315 of the pump with a pin 4323.

The pump lever 4320 is supported so as to be swung by a shaft 43200 connected to the bearing 417 at its hinged support. The first gear 4321 is coupled, by the application of pressure, to the driving shaft 5 in the direction of the axis line and is made rotatable integrally with the driving shaft 5. The second gear 4324 is adapted to engage with the first gear 4321. As described above, the second gear 4324 is constructed so as to be integral with the cam shaft 4322 equipped with the first cam 43220 and the second cam 43221.

The first cam 43220 of the cam shaft 4322 is placed at a position where it can engage with a cam curving surface 43201 of the pump lever 4320. The first cam 43220 is adapted to transfer movements, by sliding the cam curving surface 43201 of the pump lever 4320, to the shaft 4315 coupled to the pump lever 4329 with the pin 4323.

The force given by the second cam 43221 acts on the air releasing unit 44. Since the first cam 43220 and the second cam 43221 are adapted to rotate around the same rotary axis, they rotate in synchronization with each other.

Figure 8:
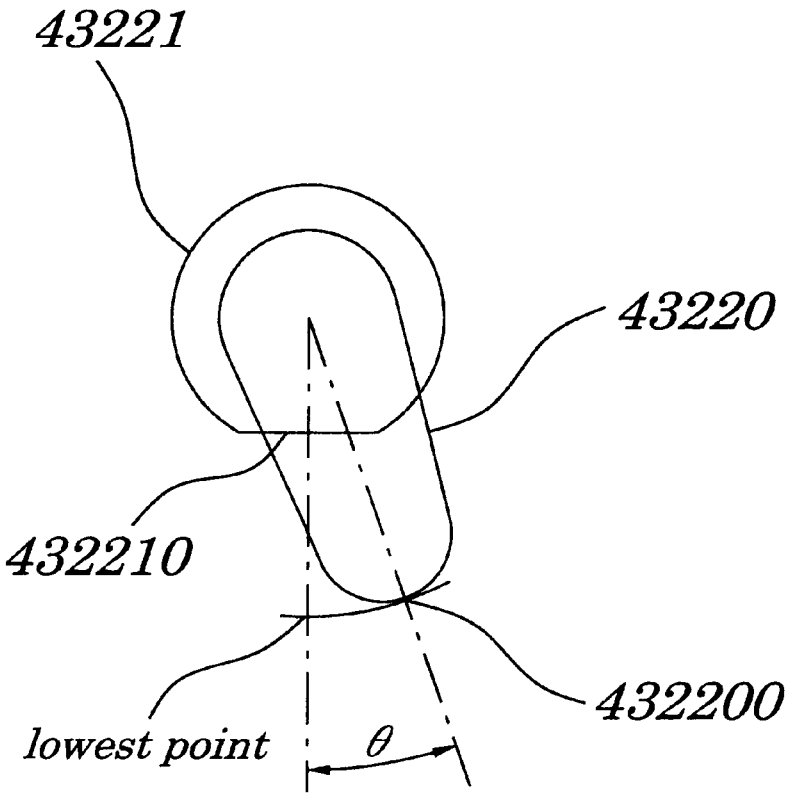
FIG. 8 is a schematic diagram illustrating the deviation of phases between a first cam and a second cam in the nozzle restoring unit shown in FIG. 1.

As depicted in FIG. 8, phases of the first cam 43220 and the second cam 43221 are set so that, before a nose 32200 of the first cam 43220 points to the lowest point representing the termination of a negative pressure generating operation of the pump driving unit, i.e., when it points to a position where an angle of θ is formed with respect to the lowest point, the flat face 432210 of the second cam points to the direction of the lowest point.

Referring to FIG. 7, the air releasing unit 44 is provided with the tube 47, one end of which is communicated with the cap 421 and the other end of which is used to release air, a crushing member 418 formed on the frame 41 and used to crush the tube 47 using the second cam 43221 to cut off air and a receiving member 419 used to support the tube when crushed. The tube 47 is held by the crushing member and the receiving member 419.

Next, operations for restoring the nozzle of the ink jet printer of the present invention are described below by referring to a timing chart shown in FIG. 9.

Figure 3B:
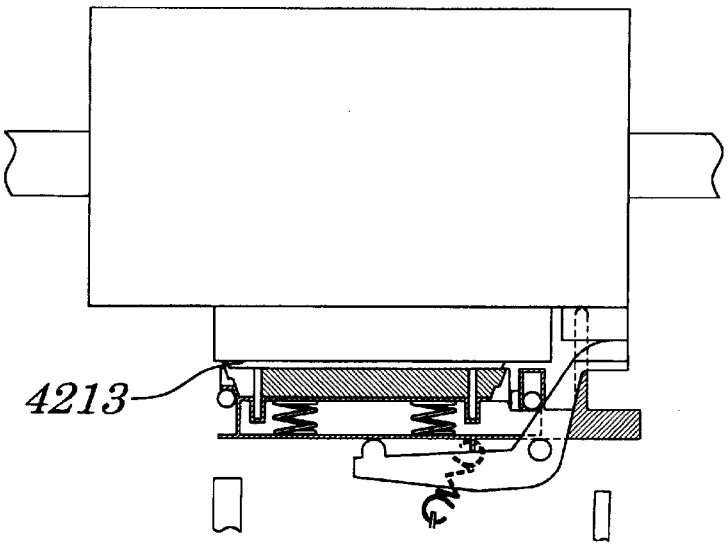

The carrier 1, during standby for printing, has been carried to the position shown in FIG. 3B past the position shown in FIG. 3A to protect the nozzle forming face 12 of the printing head supported by the carrier 1 and is standing ready for a subsequent printing in the nozzle restoring unit 4. That is, the carrier 1 moves from the left to the right direction while a right lower portion 130 of the protrusion 13 of the carrier 1 is sliding on a upper slope 4250 of the cap lever 425. The cap lever 425 rotates around a hinged support 413 in a clockwise direction and a right protrusion 4251 of the cap lever 425 lifts the bracket 424 upward. The bracket 424 lifts a cap holder 422 used to hold the cap 421 through the compressed spring 423 and presses the cap 421 against the nozzle forming face 12 as shown in FIG. 3B. At this point, a cap air chamber (i.e., sealed space) 4213 is formed by the nozzle forming face 12 and the cap 421.

To restore a clogged nozzle, the negative pressure generating unit 43 is activated. That is, an external driving force (not shown) is transferred, through the driving shaft 5, to the first gear 4321. Then, the cam shaft 4322 is rotated through the second gear 4323. When the cam shaft 4322 is rotated, the first cam 43220 is rotated, for example, from a lowest point 432200 where the first cam 43220 now exists, to the direction of an arrow mark (in a clockwise direction) as shown in FIG. 4A and, at the first rotation position 432201 shown by chain lines, the nose 432200 of the first cam 43220 is contacted with the cam curving surface 43201 of the pump lever 4320 (at first rotation position in FIG. 9).

When the first cam 43220 is further rotated, it drives the pump lever 4320 while contacting with the cam curving surface 43201 of the pump lever 4320. This causes the pump lever 4320 to swing around the rotary axis 43200 in a counterclockwise direction and to begin to lift the shaft 4315 through the pin 4323. When the first cam 43220 is rotated from the rotation position 432201 to the other position 432202, as shown in FIG. 4B, because the disc-shaped valve section 43150 of the shaft 4315 leaves a bottom face 43120 of the diaphragm 4312, air is allowed to enter or go out of, the pump chamber 4310 through a clearance 43140 between the shaft cover 4314 and the shaft 4315. At the rotation position 432202 of the first cam 43220, a right upper face 43202 of the pump lever 4320 comes into contact with the shaft cover 4314 in a bumped state (see FIG. 4B) and from this point, an exhaust stroke starts (see FIG. 9).

Figure 5A:
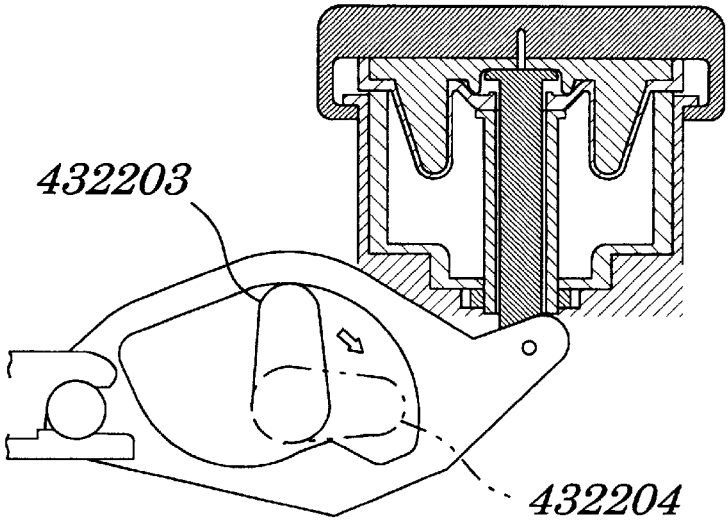
FIGS. 5A and 5B are also cross-sectional views showing operations of the negative pressure generating unit of the ink jet printer shown in FIG. 1.

When the pump lever 4320 is further swung, a right upper face 43202 of the pump lever 4320 lifts the shaft cover 4314, and in response to this action, the shaft cover 4314 lifts a bottom face 43120 of the diaphragm 4312. When the first cam 43220 is rotated from the rotation position 432202 to a position 432203, the pump moves from the position of the bottom dead center where the volume of the pump chamber 4310 is maximized to the position of the top dead center where the volume of the pump chamber 4310 is minimized (refer to FIGS. 5A and 9). This causes the pump chamber 4310 to release air within the chamber into the atmosphere through the clearance 43140 and to reduce its volume. Because of this, waste ink collected in the pump chamber 4310 is discharged downward through the clearance 43140 and flows into a waste ink container (not shown).

Then, the first cam 43220 rotates from the rotation position 432203 to a position 432204 shown by chain lines in FIG. 5 and again contacts the pump lever 4320.

Figure 5B:
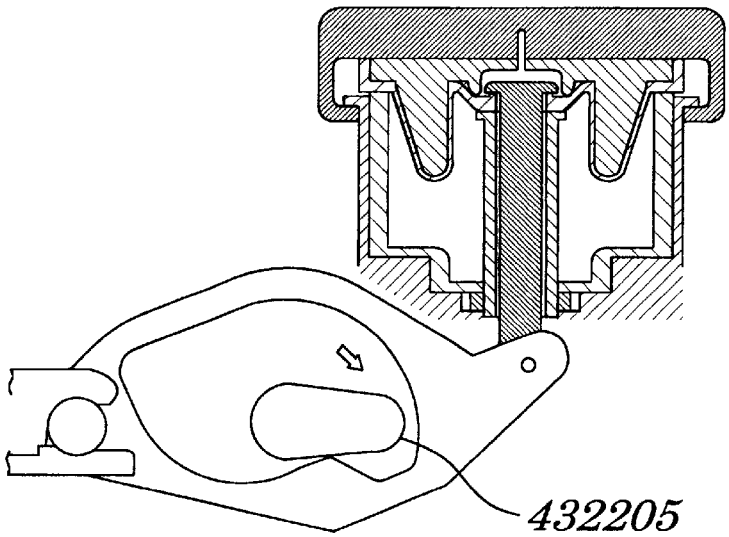

When the first cam 43220 is further rotated from the position 432204, the pump lever 4320 begins to pull down the shaft 4315 through the pin 4323. As shown in FIG. 5B, when the first cam 43220 is in the position 432205, the disc-shaped valve section 43150 of the shaft 4315 comes into contact with the bottom face 43120 of the diaphragm 4312 to block the clearance 43140 so that the pump chamber 4310 is cut off from the atmosphere and sealed. This point is a starting point of sucking stroke of the pump (refer to FIG. 9). At this point, the printing head 11 is turned ON, ink discharging operation from the nozzle is started and ink drops are discharged into the cap air chamber 4213 (refer to FIG. 9).

When the first cam 43220 is rotated from the position 432205 to the position 432200 (i.e., the position immediately before the angle range of θ) by making the cam shaft 4322 rotate further, the pump lever 4320 swings to pull the shaft 4315 down further, causing the volume of the pumping chamber 4310 to be increased and the sucking stroke to start. As the volume of the pump chamber 4310 increases, negative pressure is generated within the pump chamber 4310. The negative pressure is transferred to the cap air chamber 4213 through the communicating port 43110 of the cover 4311 and the tube 46.

This negative pressure acts on each nozzle of the printing head 11 facing the cap air chamber. By the action of the negative pressure within the cap air chamber 4213, in cooperation with actions of pressure of ink drops jetted from the nozzle, thickened ink, dust and the like within the nozzle are sucked out and collected in the cap air chamber 4213. During this operation, since the pump moves from its top dead center to its bottom dead center, waste ink within the cap air chamber 4213 is sucked out and collected within the pump chamber 4310.

When the first cam 43220 is rotated to the position 432200, i.e., the position of immediately before the angle range of θ, because the flat face 432211 of the second cam 43221 having a phase being different from that of the first cam 43220 points to the lowest point, the air releasing unit 44 begins to perform air releasing operation to cause the pressure within the cap air chamber to be atmospheric pressure.

Figure 7A:
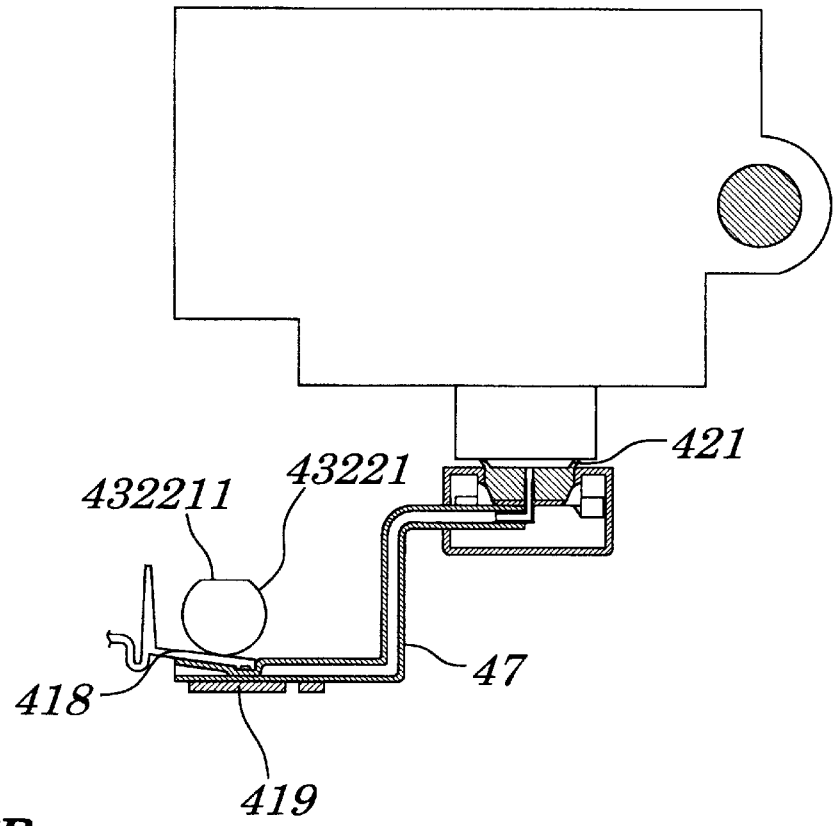
FIGS. 7A and 7B are cross-sectional views, seen from the side, showing an air releasing unit of the ink jet printer of the present invention and FIG. 7A showing the state when air is cut off and FIG. 7B showing the state when the unit is released to the atmosphere.
Figure 7B:
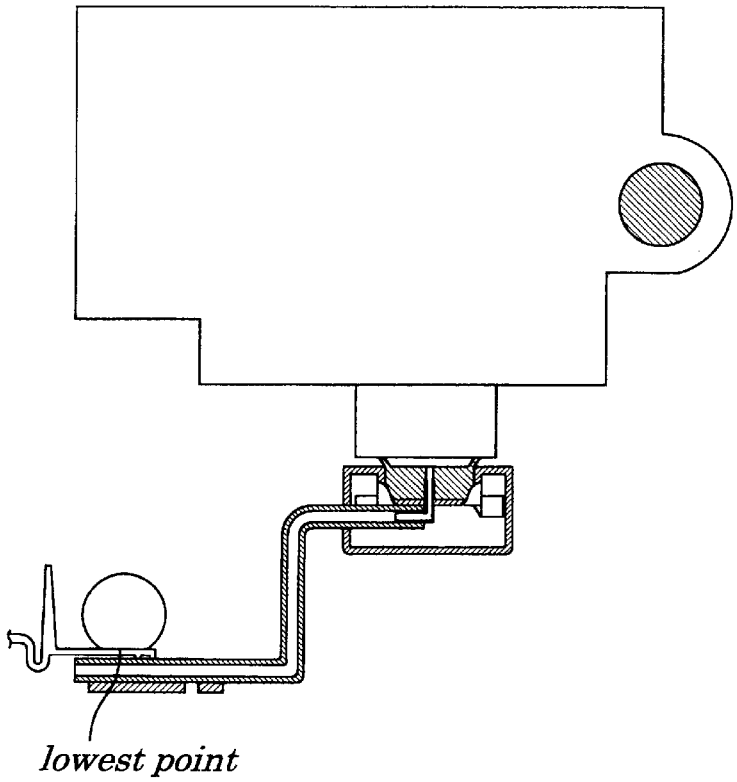

That is, as shown in FIGS. 7A and 7B, the flat face 432211 of the second cam 43221 points to the direction of the lowest point, the crushing member 418 crushing the tube 47 is released, allowing the atmosphere to come into the cap air chamber 4213 through the communicated tube 47. At this point, the cap air chamber 4213 sucks air through the air communicating port 4212 and the pump sucks the waste ink and air combined with the waste ink within the cap air chamber 4213.

Figure 9:
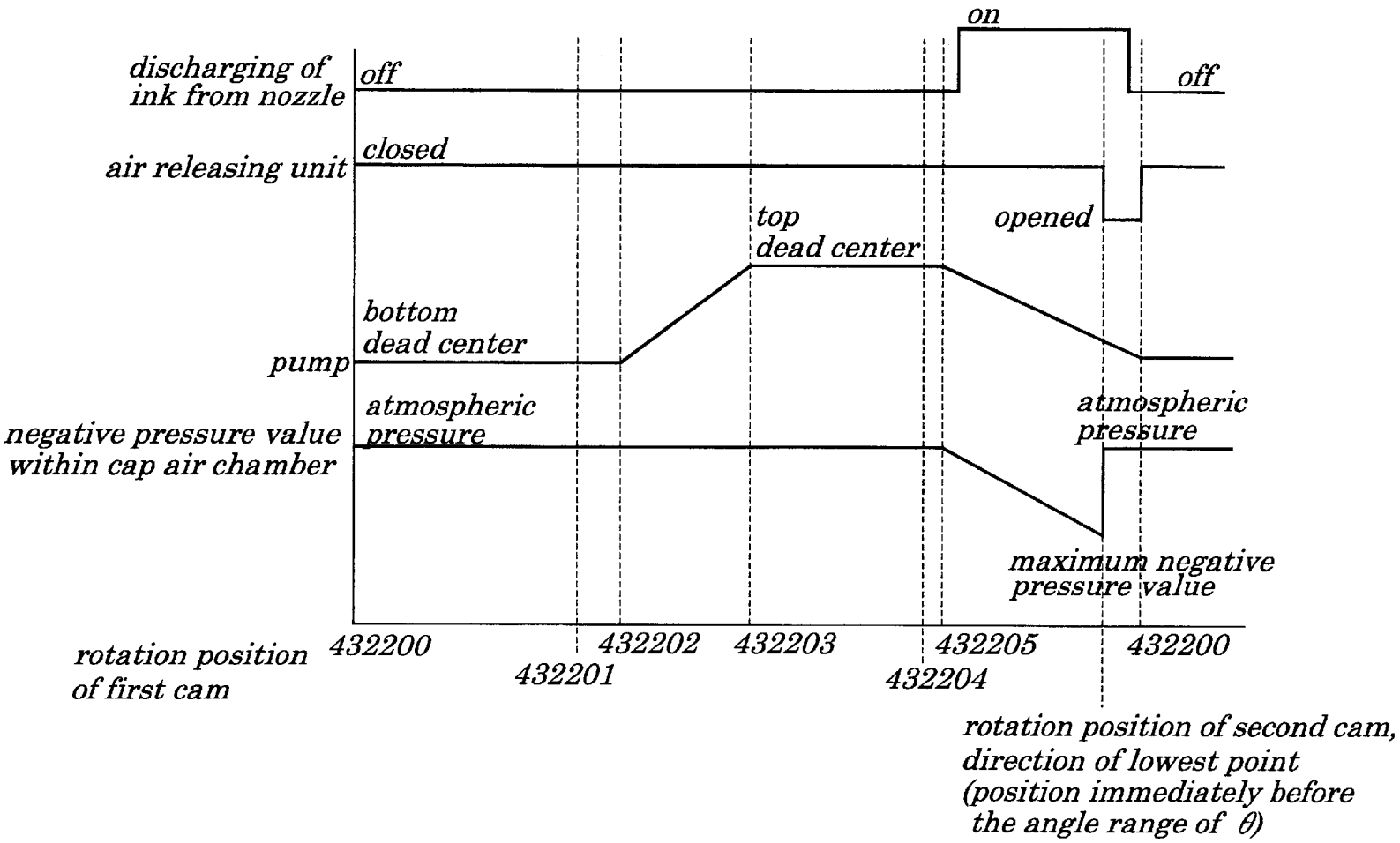
FIG. 9 is a timing chart showing operations of the nozzle restoring unit shown in FIG. 1.

As is apparent in FIG. 9, when the air releasing unit 44 allows the cap air chamber 4213 to accept air from the atmosphere, since discharging of ink from the nozzle still continues, after air is allowed to enter the cap air chamber 4213, the nozzle jets ink under the atmospheric pressure.

The first cam 43220 further rotates to the front of the rotation position 432200. At the front of the rotation position 432200, the printing head 11 is turned OFF and the discharging of ink from the nozzle is terminated. At this point, as the cap air chamber 4213 is under the atmospheric pressure, at the time of termination of discharging of ink from the nozzle, no negative pressure acts on the nozzle.

When the first cam 43220 further rotates to the rotation position 432200, the pump reaches its bottom dead center and sucks the waste ink and air combined with the waste ink within the cap air chamber 4213, and the air releasing unit 44 crushes the tube 47 to cut off air and the air releasing operation is terminated.

As described above, according to the ink jet printer of the present invention, since, while the discharging of ink from the nozzle continues, the air releasing means is activated to release the nozzle to the atmosphere, there is no residue of the negative pressure within the nozzle after sucking process by negative pressure is terminated. Accordingly, the waste ink collected within the cap after being sucked in the sucking process does not flow backward to the nozzle, thus preventing the contamination and/or mixing of color of ink caused by the waste ink Moreover, according to the present invention, because there is no need for using a keeping box, the clogging in the nozzle caused by the thickened ink, dust and the like can be prevented, thus providing restored normal printing capability.

Furthermore, according to a preferred embodiment, the negative pressure generating means and the air releasing means are individually driven by two cam members, each having a different phase, mounted on the same cam axis.

According to the present invention, the ink jet printer is so configured that the negative suction and air releasing can be performed by a predetermined timing in a simplest way.

It is thus apparent that the present invention is not limited to the above embodiment but may be changed and modified without departing from the scope and spirit of the invention.

What is claimed is:

1. An ink jet printer having a mechanism to restore at least one nozzle by suction, comprising:

nozzle restoring means including a capping, a negative pressure generating means and an air releasing means; whereby a nozzle forming face of said printing head is sealed with a cap when said at least one nozzle is not in use and a printing function of said printing head is restored, with said air releasing means closed, by sucking ink and/or dust from said at least one nozzle by negative pressure applied to a sealed space formed by said printing head and said cap;

wherein said negative pressure generating means is used to generate negative pressure to be applied to said sealed space, and said negative pressure generating means and air releasing means are individually driven by a first and a second cam members each having a different phase, which are both mounted on the same cam axis;

said air releasing means being used to release said sealed space to the atmosphere, with said air releasing means opened, while ink is being discharged from said at least one nozzle of said printing head at a terminal stage of said suction process by negative pressure;

wherein said air releasing means includes a tube, one end of which is communicated with said cap and other end of which is used to release air, a crushing member, used to crush said tube using said second cam member, having a surface eccentric to its axis, to cause movement of the crushing arm when rotated, thereby crushing the tube to cut off air and a receiving member used to support said tube when crushed.

2. The ink jet printer according to claim 1 wherein phases of said first and second cam members are set so that, before a nose of said first cam member points to a lowest point representing a termination of the negative pressure generating operation of a pump driving means or when it points to a position where an angle of θ is formed with respect to the lowest point, a flat face of said second cam member points to a direction of the lowest point.

3. The ink jet printer according to claim 1 wherein said air releasing means is activated to release said at least one nozzle to atmosphere while discharging of ink from said at least one nozzle continues.

4. The ink jet printer according to claim 1 wherein the suction by said negative pressure and releasing of air are performed by a predetermined timing.

* * * * *

UNITED STATES PATENT AND TRADEMARK OFFICE

CERTIFICATE OF CORRECTION

PATENT NO. : 6,220,690 B1
DATED : April 24, 2001
INVENTOR(S) : T. Wachi et al.

It is certified that error appears in the above-identified patent and that said Letters Patent is hereby corrected as shown below:

Title page,
After "(*)" insert -- [30] Foreign Application Priority Data of Japan
18 8938/1998 7/3/1998 --

Signed and Sealed this

Sixteenth Day of April, 2002

*Attest:*

*Attesting Officer*

JAMES E. ROGAN
*Director of the United States Patent and Trademark Office*